United States Patent [19]

Molaire et al.

[11] Patent Number: 4,661,429

[45] Date of Patent: Apr. 28, 1987

[54] PHOTOELECTROGRAPHIC ELEMENTS AND IMAGING METHOD

[75] Inventors: Michel F. Molaire; Samir Y. Farid, both of Rochester, N.Y.

[73] Assignee: Eastman Kodak Company, Rochester, N.Y.

[21] Appl. No.: 856,543

[22] Filed: Apr. 28, 1986

[51] Int. Cl.[4] ..... G03G 5/06

[52] U.S. Cl. ..... 430/70; 430/280; 430/96

[58] Field of Search ..... 430/280, 70, 56

[56] References Cited

U.S. PATENT DOCUMENTS

| | | | |
|---|---|---|---|
| 2,807,648 | 9/1957 | Pitt | 260/607 |
| 3,141,770 | 7/1964 | Davis et al. | 96/1 |
| 3,615,414 | 10/1971 | Light et al. | 96/1.6 |
| 4,026,705 | 5/1977 | Crivello et al. | 96/27 |
| 4,033,769 | 7/1977 | Williams et al. | 430/83 X |
| 4,058,401 | 11/1977 | Crivello | 96/115 |
| 4,069,055 | 1/1978 | Crivello | 96/115 |
| 4,081,276 | 3/1978 | Crivello | 96/35.1 |
| 4,349,618 | 9/1982 | Kondo et al. | 430/81 X |
| 4,529,490 | 7/1985 | Crivello et al. | 204/159.11 |

*Primary Examiner*—J. David Welsh

*Attorney, Agent, or Firm*—John R. Everett

[57] ABSTRACT

A photoelectrographic element comprising a conductive layer in electrical contact with an acid photogenerating layer which (a) is free of photopolymerizable materials and (b) comprises an electrically insulating binder and an acid photogenerator is disclosed. A method for forming images with the element is also disclosed.

14 Claims, No Drawings

PHOTOELECTROGRAPHIC ELEMENTS AND IMAGING METHOD

FIELD OF THE INVENTION

This invention relates to new photoelectrographic elements, an imaging method using such elements and novel acid photogenerators.

BACKGROUND OF THE INVENTION

Acid photogenerators are known for use in photoresist imaging elements. In such imaging processes, the acid photogenerator is coated on a support and imagewise exposed to actinic radiation. The layer bearing the acid photogenerator is then contacted with a photopolymerizable or curable composition such as epoxy and epoxy-containing resins. In the exposed areas, the acid photogenerator generates a proton which catalyzes the polymerization or curing of the photopolymerizable composition. Acid photogenerators are disclosed, for example, in U.S. Pat. Nos. 4,081,276; 4,058,401; 4,026,705; 2,807,648; 4,069,055; and 4,529,490.

Electrophotographic compositions and imaging processes are also known. In these processes an electrophotographic element bearing a layer containing a photoconductor is electrostatically charged and then imagewise exposed to form a latent electrostatic image. The latent electrostatic image is subsequently developed with a toner composition. Electrophotographic elements and processes are disclosed, for example, in U.S. Pat. Nos. 3,141,770, 3,615,414 and all of the patents cited therein. The problem is that with any electrophotographic element, it is always necessary to electrostatically charge the element prior to imagewise exposure.

SUMMARY OF THE INVENTION

The present invention provides a photoelectrographic element comprising a conductive layer in electrical contact with an acid photogenerating layer which (a) is free of photopolymerizable materials and (b) comprises an electrically insulating binder and an acid photogenerator. The elements of this invention can be imagewise exposed and electrostastically charged in any order.

The present invention also provides a photoelectrographic imaging method comprising the steps of:

(a) providing a photoelectrographic element comprising a conductive layer in electrical contact with an acid photogenerating layer which (i) is free of photopolymerizable materials and (ii) comprises an electrically insulating binder and an acid photogenerator;

(b) carrying out the following steps (b) (i) and (b) (ii) concurrently or separately in any order, to form an electrostatic latent image, (i) imagewise exposing the acid photogenerating layer to actinic radiation, (ii) electrostatically charging the acid photogenerating layer, and (c) developing the electrostatic latent image with charged toner particles.

The present invention also provides a polymer comprising appended anionic groups having aromatic onium salt photogenerators as the counter ion.

The imaging method and elements of this invention use acid photogenerators in thin layers coated over a conductive layer to form images. This imaging technique or method takes advantage of our discovery that exposure of the acid generator significantly increases the dark decay of electrostatic charges in the exposed area of the layer. Imagewise radiation of the acid photogenerator layer creates differential dark decay between exposed and unexposed areas. In the method exposure can occur before, after or cotemperaneously with the charging step. This is different from electrophotographic imaging techniques where the electrophotographic element must always be charged electrostatically prior to exposure.

The photoelectrographic elements of the invention are also advantageous in that the imagewise differential dark decay of electrostatic charges are erasable with heat. Moreover, the imagewise conductivity differential created by the exposure is permanent unless the element is subjected to heat. Thus, multiple copies of a document can be made from a single exposure.

PREFERRED EMBODIMENTS

Especially useful photoelectrographic elements of this invention utilizes acid photogenerators selected from the group consisting of aromatic onium salts including triarylselenonium salts and aryldiazonium salts, and 6-substituted-2,4-bis(trichloromethyl)-5-triazines. Particularly useful acid photogenerators are arylhalonium salts and triarylsulfonium salts.

DETAILS OF THE INVENTION

In preparing acid photogenerating layers the acid photogenerator is dissolved in a suitable solvent in the presence of an electrically insulating binder. Then a sensitizer, if desired, is dissolved in the resulting solution prior to coating on a conducting support.

Solvents of choice for preparing coating compositions of the acid photogenerators include a number of solvents such as aromatic hydrocarbons such as benzene and toluene; acetone, 2-butanone; chlorinated hydrocarbons such as ethylene dichloride, trichloroethane and dichloromethane, ethers such as tetrahydrofuran; or mixtures of these solvents.

The acid photogenerating layers are coated on a conducting support in any well-known manner such as doctor-blade coating, swirling, dip-coating, and the like.

The acid photogenerating materials should be chosen so that at certain concentrations in the layer, the layer has a relatively small dark decay before irradiation, but the dark decay level should increase by radiation exposure. In preparing the coating composition, useful results were obtained where the acid photogenerator was present in an amount equal to at least about 1 weight percent of the coated layer. The upper limit of the amount of acid photogenerator is not critical as long as no deleterious effect on the initial dark decay of the film is encountered. A preferred weight range for the acid photogenerator in the coated and dried composition is from 10 weight percent to about 60 weight percent.

Coating thicknesses of the acid photogenerator can vary widely. Normally a wet coating thickness in the range from about 0.1 μm to about 50 μm are useful. Coating thicknesses outside these ranges will also be useful.

The photoelectrographic elements of the present invention are employed in the photoelectrographic process described hereinbefore. In this process, the element is given a blanket electrostatic charge by placing the same under a corona discharge which serves to give a uniform charge to the surface of the acid photogenerator layer. The layer is then exposed imagewise. Exposure and charging can be carried out in any order or at the same time. The charge is dissipated by the layer in exposed areas. Thus, the combination of the charging and imagewise exposure steps create an electrostatic latent image of the type produced in electrophotographic processes.

The electrostatic latent image is then developed or transferred to another sheet and developed by treatment with a medium comprising electrostatically attractable particles. Such particles are used extensively in developing electrophotographic images. The particles are generically referred to as toners. The toners in the form of a dust, powder, a pigment in a resinous carrier, or in a liquid developer in which the toner particles are carried in an electrically insulating liquid carrier. Methods of development of this type are widely known and have been described in the electrophotographic patent literature in such patents, for example, as U.S. Pat. No. 2,296,691 and in Australian Pat. No. 212,315.

The charged toner may have the same sign as the electrographic latent image or the opposite sign. In the former case, a negative image is developed. In the latter case, a positive image is developed.

Any compound which generates an acid upon exposure will be useful. Useful aromatic onium salt acid photogenerators are disclosed in U.S. Pat. Nos. 4,081,276; 4,529,490; 4,216,288; 4,058,401; 4,069,055; 3,981,897; and 2,807,648. Such aromatic onium salts include Group Va, Group VIa and Group VIIa elements. The ability of triarylselenonium salts, aryldiazonium salts and triarylsulfonium salts to produce protons upon exposure to light is described in detail in "UV Curing, Science and Technology", Technology Marketing Corporation, Publishing Division, 1978.

A representative portion of the useful aryl iodonium salts are the following:

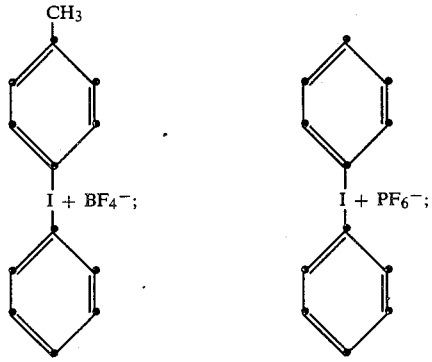

-continued

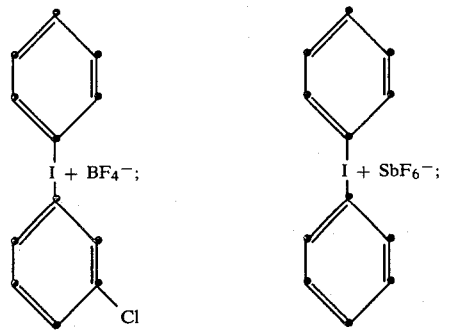

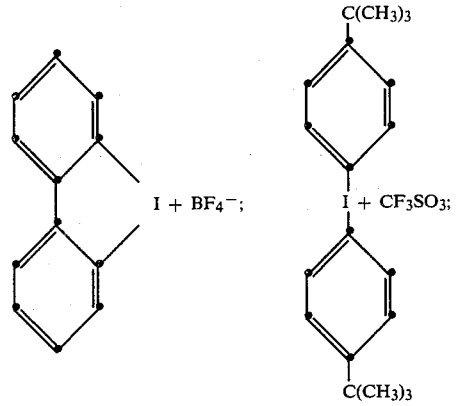

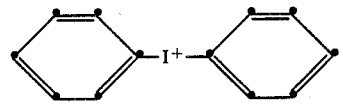

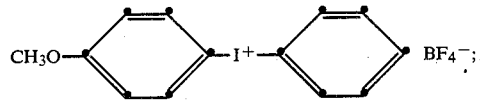

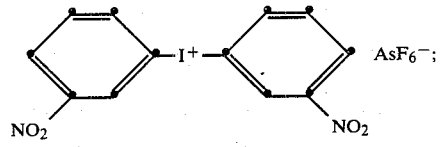

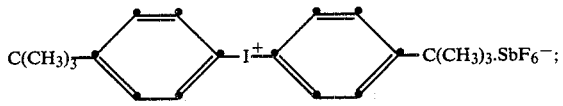

and

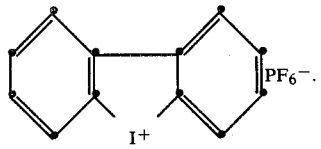

A representative portion of useful Group Va onium salts are:

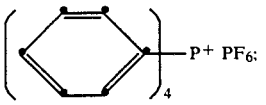
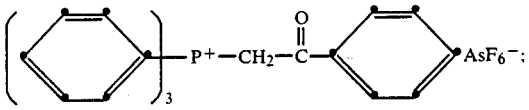
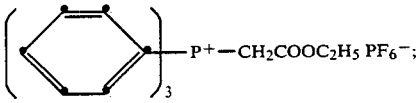
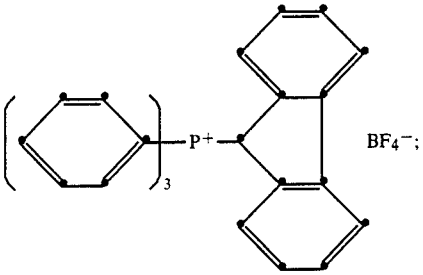
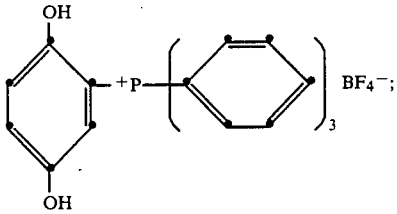
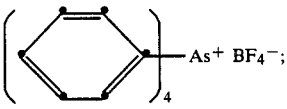
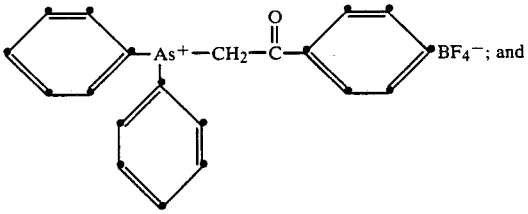
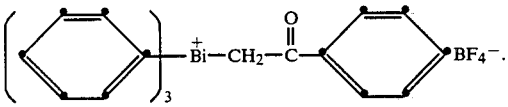
A representative portion of useful Group VIa onium salts, including sulfonium salts, are:
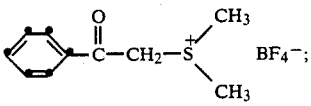
-continued
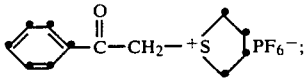
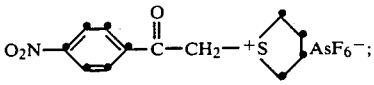
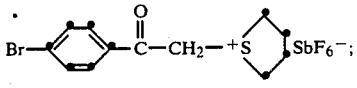
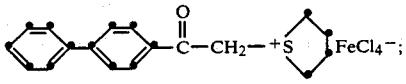
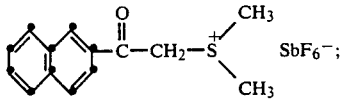
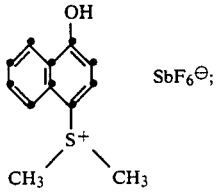
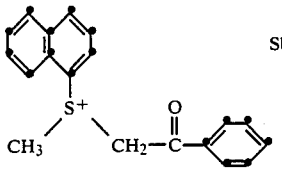
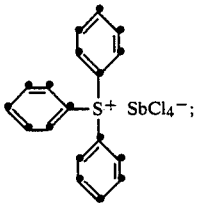
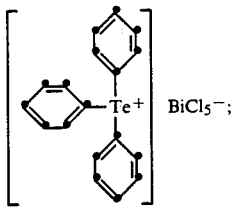
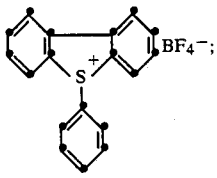
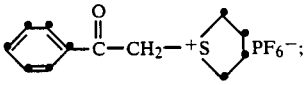

-continued

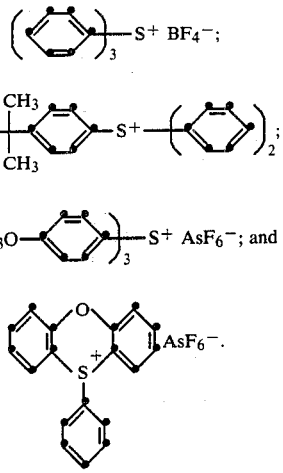

Other salts from which acid photogenerators may be selected are:

1. Triarylselenonium salts, such as disclosed in Belgian Pat. Nos. 828,670 and 833,472.

The following salts are representative:

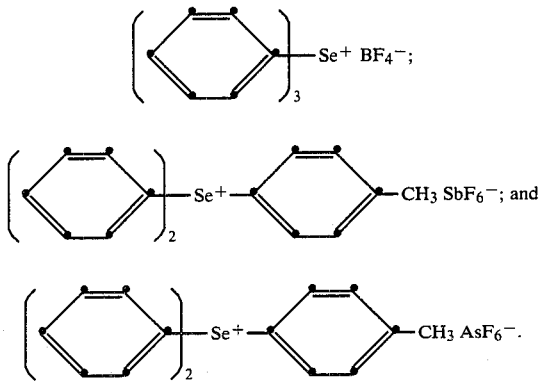

2. Aryldiazonium salts such as disclosed in U.S. Pat. Nos. 3,205,157; 3,711,396; 3,816,281; 3,817,840 and 3,829,369. The following salts are representative:

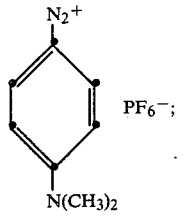

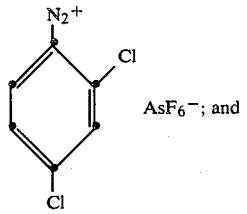

-continued

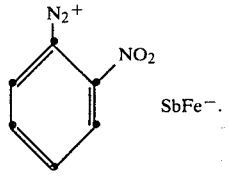

3. 6-Substituted-2,4-bis(trichloromethyl)-5-triazines such as disclosed in British Pat. No. 1,388,492. The following compounds are representative:

| R |
|---|
| 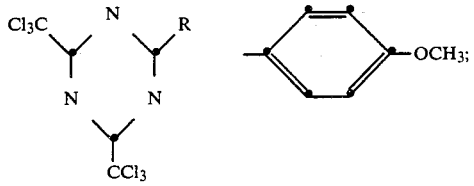 |
| 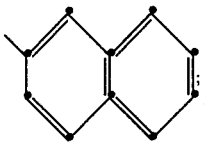 |
| 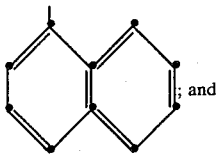 |
| 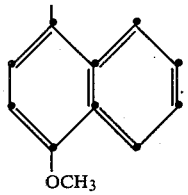 |

Another especially useful group of acid photogenerators include polymers comprising appended anionic groups having an aromatic onium acid photogenerator as the positive counter ion. Examples of useful polymers include

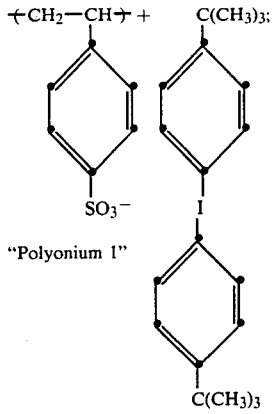

"Polyonium 1"

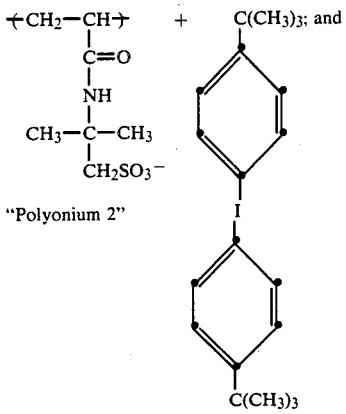

"Polyonium 2"

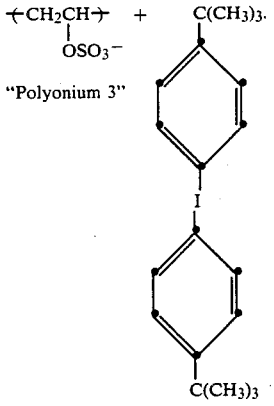

"Polyonium 3"

The polymers of this invention are made by simply exchanging ions between a commercially purchased or other anionic polymer salt and a simple nonpolymeric onium salt in aqueous solution. For example, a polymeric sulfonate salt will readily exchange anions in water with a diaryliodonium hydrogen sulfate. The reaction is driven to completion by precipitation of the new diaryliodonium polymeric sulfonate salt.

Alternatively, the ion exchange could be performed on an anionic monomer and the monomer, with any desirable comonomers, polymerized by conventional polymerization technniques.

A specific preparation follows for Polyonium 1.

In a one liter beaker, 3.27 gm (0.00690 mole) of di-(4-t-butylphenyl)iodonium hydrogen sulfate was dissolved in about 300 ml of water. To the stirred solution in the beaker, was added dropwise 1.09 gm (0.00575 mole) of preformed poly(sodium p-styrenesulfonate) dissolved in about 200 ml of water. A precipitate of polyonium 1 started to form on mixing. After complete addition, the precipitate was filtered, redissolved in dichloromethane, washed twice with water and reprecipitated into a large volume of heptane. The polymer was then filtered and dried at 100° C. for ten minutes.

Such polymers should comprise sufficient cationic acid photogenerator groups to achieve the differential dark decay for imaging purposes. In general, such polymers comprise from 1 to 100 mole percent of acid generating groups. Ionic polymers from which the polyoniums of the present invention can be made are disclosed in U.S. Pat. Nos. 3,042,221; 3,506,707; 3,547,899; 3,411,911; 3,062,674 and 3,220,544.

Useful electrically insulating binders for the acid photogenerating layers include polycarbonates, polyesters, polyolefins, phenolic resins and the like. Desirably, the binders are film forming. Mixtures of such polymers can also be utilized. To be useful, such polymers should be capable of supporting an electric field in excess of $6\times10^5$ V/cm and exhibit a low dark decay of electrical charge.

Preferred binders comprise styrene-butadiene copolymers; silicone resins; styrene-alkyd resins; soya-alkyd resins; poly(vinyl chloride); poly(vinylidene chloride); vinylidene chloride, acrylonitrile copolymers; poly(vinyl acetate); vinyl acetate, vinyl chloride copolmyers; poly(vinyl acetals), such as poly(vinyl butyral); polyacrylic and methacrylic esters, such as poly(methyl methacrylate), poly(n-butyl methacrylate), poly(isobutyl methacrylate), etc; polystyrene; nitrated polystyrene; poly(vinylphenol)polymethylstyrene; isobutylene polymers; polyesters, such as phenolformaldehyde resins; ketone resins; polyamide; polycarbonates; etc. Methods of making resins of this type have been described in the prior art, for example, styrene-alkyd resins can be prepared according to the method described in U.S. Pat. Nos. 2,361,019 and 2,258,423. Suitable resins of the type contemplated for use in the photoconductive layers of this invention are sold under such tradenames as Vitel PE 101-X, Cymac, Piccopale 100, and Saran F-220. Other types of binders which can be used include such materials as paraffin, mineral waxes, etc.

The amount of spectral or speed enhancing sensitizer which can be added to a particular acid generating composition to give optimum sensitization varies widely. The optimum amount will, of course, vary with the acid photogenerator used and the thickness of the coating as well as with the particular sensitizer. In general, substantial speed gains and wavelength adjustments can be obtained where an appropriate sensitizer is added at a concentration up to about 30 percent by weight based on the weight of the acid generating composition.

The iodonium salt acid photogenerators may be sensitized using ketones such as xanthones, indandiones, indanones, thioxanthones, acetophenones, benzophenones or other aromatic compounds such as anthracenes, diethoxyanthracenes, perylenes, phenothiazines, etc.

Triarylsulfonium salt acid generators may be sensitized by aromatic hydrocarbons, anthracenes, perylenes, pyrenes and phenothiazines.

Useful conducting layers include any of the electrically conducting layers and supports used in electrophotography. These include, for example, paper (at a relative humidity about 20 percent); aluminum-paper laminates; metal foils, such as aluminum foil, zinc foil, etc.; metal plates, such as aluminum, copper, zinc, brass, and galvanized plates; regenerated cellulose and cellulose derivatives; certain polyesters, especially polyesters having a thin electroconductive layer (e.g. cuprous iodide) coated thereon; etc.

The following examples further clarify how to make and use the invention of this application.

EXAMPLE 1

A general formulation consisting of 13.5 gm of poly(methyl methacrylate), 1 gm of 9,10-diethoxyanthracene sensitizer and 70 gm of dichloromethane was mixed for complete dissolution on a roller mill. Aliquots of this formulation (7 gm) were taken with 0.1 gm of the acid generator being tested. Each of these solutions were coated on a copper coated polyester support with a 0.0254 mm knife, and dried at 90° C. in an oven for about 30 minutes. The coated films were cut into 50×50 mm samples for exposure to a high pressure Hg lamp for 40 seconds. After exposure through a density step tablet, the films were corona charged for 60 seconds negatively, followed by toning with a positive toner for 60 seconds. The results are tabulated in Table I.

EXAMPLE 2

Use of Spectral Sensitizers in the Acid Photogenerating Layer

A stock solution containing 9 gm of poly(methyl methacrylate), 6 gm of

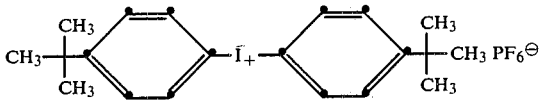

and 70 gm of dichloromethane was prepared. Aliquots (8.5 gm) of this stock solution were mixed with 0.1 gm of sensitizers 1, 2, 3 and 4 below:

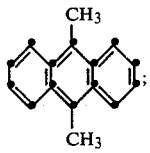

(1)

9,10-dimethylanthracene

TABLE I

| Acid Photogenerator | T14 Density Step Tablet Speed Solid Steps | Contrast |
|---|---|---|
| 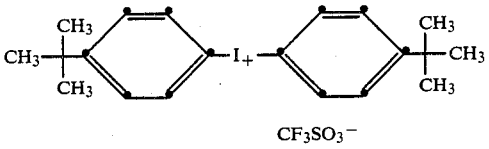 | 3 | Very Good |
| 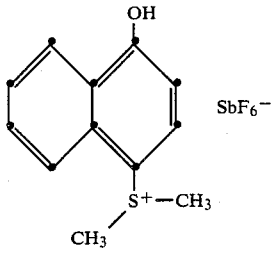 | 2 | OK |
| 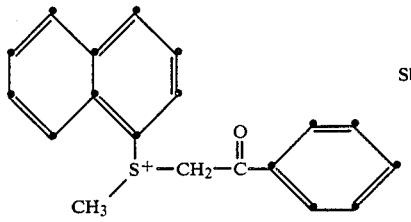 | 6 | Very Good |
| 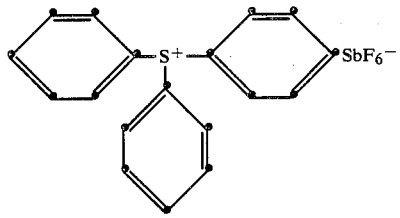 | 4–5 | Very Good |

-continued (2)

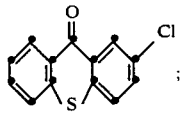

2-chlorothioxanthone (3)

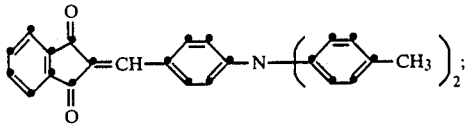

2-[4-(4-ditolylamino)benzylidene]-1,3-indandione (4)

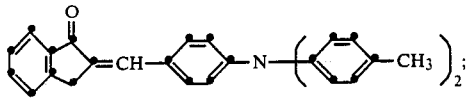

2-[4-(4-ditolylamino)benzylidene]-1-indanone (5)

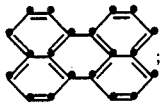

; and perylene

These solutions were hand coated on a copper coated polyester support using a 0.05 mm blade and baked at 90° C. for about 15 minutes; 50×50 mm samples of each coating were exposed with a 200 watt high pressure Hg lamp for 40 seconds through a step tablet (0.15 log E). The exposed samples were corona charged for 60 seconds and developed for 60 seconds in a liquid toner. The results are tabulated in Table II.

TABLE II

| Sensitizers | Imaging Results |
|---|---|
| Control | 0 |
| Sensitizer 1 | 6 solid steps |
| Sensitizer 4 | 5–6 steps |
| Sensitizer 3 | 3–4 steps |
| Sensitizer 2 | 3 steps |

This example illustrates how the use of sensitizers can improve the spectral performance of the elements of this invention.

EXAMPLE 3

Concentration Effect

A series of formulations using di(4-t-butylphenyl)iodonium hexafluorophosphate and poly(methyl methacrylate) in various concentrations with 9,10-diethoxyanthracene (0.1 gm) as the sensitizer were coated and tested similar to Example 2. The results are shown in Table III.

TABLE III

| Iodonium Salt Concentration (%) | Imaging Results |
|---|---|
| 1 | very faint image |
| 5 | 5 steps, fair image |
| 10 | good image, 6 solid steps |
| 20 | good image, 6 solid steps |
| 30 | good image, 6 solid steps |
| 40 | good image, 6 solid steps |
| 50 | good image, 6 solid steps |
| 60 | good image, 6 solid steps |

EXAMPLE 4

The Use of Polymeric Onium Salts in Photoelectrographic Imaging

Coatings were made from a general formulation comprising 0.68 gm of the polymeric salt being tested and 0.05 gm of 9,10-diethoxyanthracene dissolved in 7 gm of dichloromethane. Each of the formulations were coated on copperized polyester support with a 0.0254 mm coating knife and dried at 90° C. for 30 minutes in an oven. The coated films were cut in 2×2 samples and tested as defined in Example 1. The results are tabulated in Table IV.

TABLE IV

| | T14 Speed Solid Steps | Contrast |
|---|---|---|
| 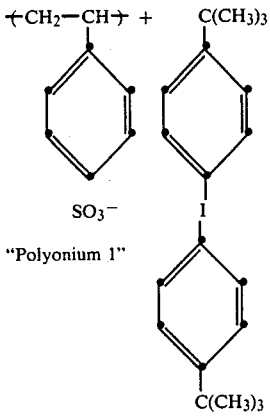 "Polyonium 1" | 3 | Very Good |
| 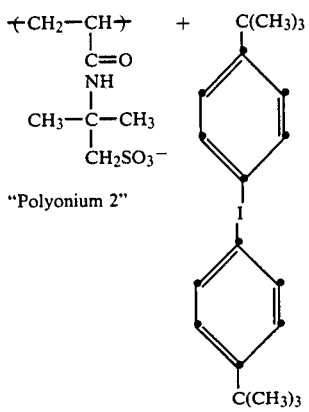 "Polyonium 2" | 3–4 | OK |

EXAMPLE 5

The iodonium salt

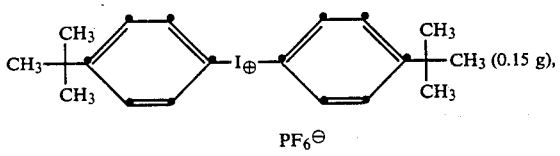

poly(vinylphenol) (1.35 gm) and 0.1 g of 9,10-diethoxyanthracene in tetrahydrofuran were coated on a copperized support and baked at 100° C. for about 15 minutes. Samples were exposed for 1 second to a Hg lamp, charged for 60 seconds negatively and developed for 60 seconds in a positive liquid toner. The speed of this layer was excellent. Six solid steps were developed.

The invention has been described in detail with particular reference to preferred embodiments thereof, but it will be understood that variations and modifications can be effected within the spirit and scope of the invention.

We claim:

1. A photoelectrographic element comprising a conductive layer in electrical contact with an acid photogenerating layer which (a) is free of photopolymerizable materials and (b) comprises an electrically insulating binder and an acid photogenerator.

2. The element of claim 1 wherein the acid photogenerator is selected from aromatic onium salts, and 6-substituted-2,4-bis(trichloromethyl)-5-triazines.

3. The element of claim 1 wherein the acid photogenerator is selected from the group consisting of arylhalonium salts and triarylsulfonium salts.

4. The element of claim 1 wherein the acid photogenerator is a polymer comprising an appended anionic group having an aryliodonium acid photogenerator counter ion.

5. The element of claim 1 wherein the acid photogenerator is a polymer comprising an appended anionic group having a di-(4-t-butylphenyl)iodonium acid photogenerator counter ion.

6. The element of claim 1 wherein the acid photogenerator is selected from the group consisting of

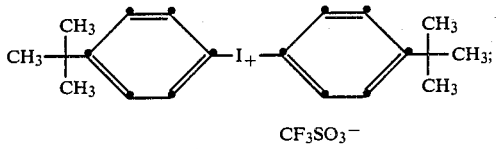

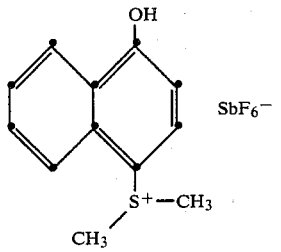

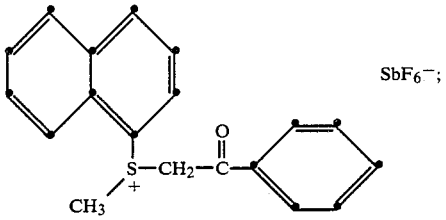

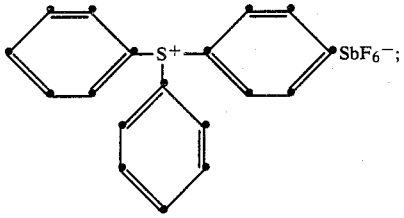

-continued

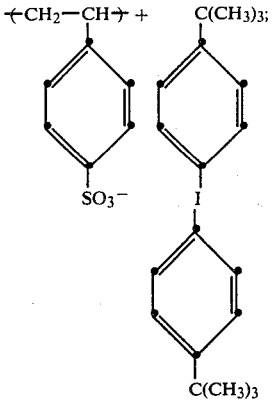

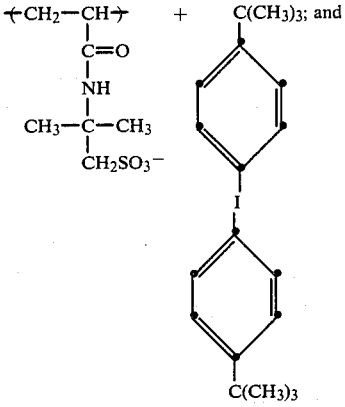

7. The element of claim 1, 2, 3, 4, 5 or 6 in which the acid photogenerating layer also comprises a spectral sensitizer.

8. The element of claim 1, 2, 3, 4, 5 or 6 in which the acid photogenerating layer comprises at least one weight percent of the acid photogenerator.

9. The element of claim 2, 3 or 6 wherein the binder is selected from the group consisting of hydroxyphenyl containing polymers.

10. The element of claim 2, 3 or 6 wherein the binder is poly(vinylphenol).

11. A photoelectrographic method for imaging, comprising the steps of:

(a) providing a photoelectrographic element comprising a conductive layer in electrical contact with an acid photogenerating layer which (a) is free of photopolymerizable materials and (b) comprises an electrically insulating binder and an acid photogenerator;

(b) carrying out the following steps (i) and (ii) separately or concurrently in any order to form an electrostatic latent image, (i) imagewise exposing the acid photogenerating layer to actinic radiation, (ii) electrostatically charging the acid photogenerating layer, and (c) developing the electrostatic latent image with charged toner particles.

12. The method of claim 11 wherein step (i) is carried out prior to step (ii).

13. The method of claim 11 wherein step (ii) is carried out before step (i).

14. The method of claim 9 wherein the photoelectrographic element is selected from those of claims 2, 3, 4, 5 or 6.

* * * * *